United States Patent [19]

Schuster et al.

[11] Patent Number: 4,529,955

[45] Date of Patent: Jul. 16, 1985

[54] METHOD AND APPARATUS FOR CONTROLLING COOLANT DISTRIBUTION IN MAGNETIC COILS

[75] Inventors: John R. Schuster, Encinitas; Hakan N. Lofstedt, San Diego, both of Calif.

[73] Assignee: FDX Patents Holding Company, N.V., De Ruyterkade, Netherlands Antilles

[21] Appl. No.: 356,458

[22] Filed: Mar. 9, 1982

[51] Int. Cl.[3] ..... H01F 5/00

[52] U.S. Cl. ..... 335/300; 335/216; 376/133; 336/60

[58] Field of Search ..... 335/300, 216; 174/15 R, 174/15 CA, 15 S, 15 C; 336/60, 61; 376/133

[56] References Cited

U.S. PATENT DOCUMENTS

| | | | |
|---|---|---|---|
| 772,288 | 10/1904 | Neall | 336/60 |
| 3,056,071 | 9/1962 | Baker et al. | 335/300 |
| 3,416,111 | 12/1968 | Bogner | 335/216 X |
| 3,483,493 | 12/1969 | Kafka | 335/216 |
| 3,514,730 | 5/1970 | Kassner | 335/216 |
| 3,559,126 | 1/1971 | Drautman | 335/216 |
| 3,562,685 | 2/1971 | Zar | 335/216 |
| 3,869,686 | 3/1975 | Benz | 174/15 CA X |
| 3,956,724 | 5/1976 | Fagan | 335/300 X |

*Primary Examiner*—George Harris

*Attorney, Agent, or Firm*—Schwartz, Jeffery, Schwaab, Mack, Blumenthal & Evans

[57] ABSTRACT

Disclosed is a method and apparatus for controlling coolant distribution in ohmic heating and other poloidal field magnetic coils. The apparatus consists of a coolant inlet and outlet arrangement with spiral coolant channels positioned therebetween. The spiral coolant channels are designed to control the coolant pressure drop within the coil turns and hence the coolant flow distribution within the entire coil. The coolant channels of the present invention provide coil turns with improved structural and cooling characteristics over the prior art. The method disclosed consists of controlling the flow distribution of cooling fluid through coolant channels in a magnetic coil by using spiral channels of a specially designed length, width and spiral configuration.

29 Claims, 7 Drawing Figures

View A

View B

METHOD AND APPARATUS FOR CONTROLLING COOLANT DISTRIBUTION IN MAGNETIC COILS

FIELD OF THE INVENTION

The present invention relates generally to a method of controlling the flow distribution of coolant fluid through cooling channels in a magnetic coil. The present invention also relates generally to a cooling channel in a magnetic coil fashioned to provide for proper flow distribution of coolant within the coil and to provide cooling characteristics such that the resulting temperature distribution minimizes peak stresses. More particularly, the invention relates to a method and apparatus for providing spiral coolant channels in the ohmic heating coils of a toroidal reactor to ensure adequate coolant flow and proper flow and cooling distribution through the ohmic heating coils.

BACKGROUND OF THE INVENTION

In a toroidal reactor utilizing ohmic heating coils that are constantly energized, flowing coolant must be distributed to the various turns of the ohmic heating coil in order to remove the joule heat generated. In prior art tokamak fusion reactors (TFR), the devices were experimental and large enough that OH coil flow distribution problems seldom arose. There was sufficient space in the vicinity of coolant inlets and coolant outlets to control the static pressure rise and the static pressure drops respectively and the cooling requirements were such that adequate coolant flow could be attained with little regard to the coolant flow path through the ohmic heating coils per se. In commonly assigned U.S. Pat. No. 4,367,193 filed Oct. 22, 1979, and U.S. Pat. No. 4,363,775 filed June 10, 1980, there is disclosed a compact TFR with the central ohmic heating (OH) coil disposed in the very limited space surrounding the main axis of the TFR and inside of the toroidal field (TF) turns. Because of the limited space available for the OH coil coolant manifold between the OH and TF coils, a high pressure loss results in this manifold. This high pressure loss makes it difficult to achieve a good distribution of coolant flow to the various turns of the OH coil, and other poloidal field (PF) coils, even where the inlet manifold configuration is designed to offset to the greatest extent possible the outlet manifold effects.

In addition, owing to the temperature gradient existing in the OH and other PF coils, there exists a need to create a specific temperature profile in the coils so that proper coil resistivity is maintained.

Because of the density and the distribution of the current flow in the OH and PF coils of a compact TFR, there is a need to dissipate very high amounts of heat in a very small space and preferably in an unequal manner. The density is non-uniform, being greater at the smaller radii, thus producing non-uniform, non-optimum hoop stress, with the smallest radius being the most highly stressed.

SUMMARY OF THE INVENTION

Accordingly, it is an object of the present invention to provide an improved method for controlling coolant flow through magnetic coils. It is also an object of this invention to provide a method for making cooling channels in magnetic coils having a sufficiently large pressure drop to overcome the effects of losses in other portions of the coolant circuit.

It is an additional object of the invention to provide a cooling system for magnetic coils having good flow distribution.

It is an additional object of the invention to provide a cooling system for magnetic coils having improved structural characteristics.

It is an additional object of this invention to provide cooling channel pressure drops in magnetic coils that are a large enough fraction of the total coolant circuit pressure drop to achieve good flow distribution.

It is an object of this invention to provide a mechanism for removing, effectively and efficiently, large amounts of joule heat from compact ohmic heating and poloidal coils.

It is an object of this invention to provide unequal cooling in a magnetic coil by controlling the pressure drop and the coolant flow rate through the coil.

It is still a further object of the invention to provide cooling channel shapes for OH and PF coils that make use of spiralling or involute channel paths.

It is an object of the present invention to provide an improved coolant channel design for magnetic coils which permits fewer coolant channels to be used to effectively blanket the entire coil turn.

It is an object of the present invention to provide an improved coolant channel design for magnetic coils that results in a lower coolant pressure loss at the junction of the manifold and cooling channel.

To achieve the foregoing and other objects and in accordance with the purpose of the present invention as embodied and broadly described herein, there is disclosed a method and apparatus for controlling the flow distribution of cooling fluid through cooling channels in a magnetic coil. In accordance with the invention, cooling fluid flows through an inlet means to a cooling channel and to a coolant outlet means. The cooling channel is so designed and dimensioned so as to ensure a balancing of the static pressure rise in the coolant inlet and the static pressure drop in the coolant outlet. In order to ensure proper flow distribution and proper controlled cooling of the magnetic coil, the coolant channel pressure drop must represent a significant fraction of the total coolant circuit pressure drop. Preferably, the cooling channels are of a spiral or involute shape so as to provide a long coolant path within the magnetic coil.

The coolant channels of the present invention may preferably have channels whose width, in the plane of the coil turn, either diverges, remains constant or converges with increasing radius from the coil center, thus affecting the coolant pressure drop within the coil turn and the bulk temperature distribution within the coil turn as a function of the radial position of the coil coolant channel.

Preferably, the spiral or involute coolant channels are etched or machined into the surface of a flat, washer-like member which constitutes a portion of the cooling coil. An additional flat washer-like member may preferably be provided that fits over the etched or machined portion to provide the internal cooling channels.

Alternatively, the etched or machined coolant channels can be arranged in proximity with the insulated side of the adjacent coil and thereby run within the coil turn but along the surface of it. Alternatively, the coolant channel can be formed within a solid washer-like member.

Preferably, the angle of the spiral of the coolant channel and the cross-sectional area of the coolant channel are continuously controlled to provide very accurate control over the flow of coolant through the magnetic coil member and thereby control the heat removal from the magnetic coil member. The spiral or involute channels are longer than straight radial channels resulting in a higher average coolant velocity and a larger pressure drop. A large pressure drop in the channels, relative to the unbalanced combined pressure losses of the inlet and outlet coolant manifolds, allows better control of the coolant flow distribution. It is therefore an aspect of the present invention to provide cooling channel pressure drop losses in ohmic heating and other PF coils which are a large fraction of the overall cooling circuit loss in order to achieve proper and adequate flow distribution by balancing the static pressure rise in the inlet manifold against the static pressure loss in the outlet manifold. It is a further aspect of the current invention to provide a coolant circuit for ohmic heating and other PF coils in a compact TFR wherein there exists a need to dissipate large amounts of heat from a very small space.

It is also an aspect of the present invention to provide a method for designing magnetic coil cooling channels that follow a spiral or involute path and have a channel width in the plane of the coil that either diverges, remains constant, or converges with increasing radius. The method may include selecting the proper coolant channel wall angle to allow coolant channel pressure drop to be tailored to give a good coolant flow distribution. The method may also provide for the modification of the radial variation in cooling characteristics, thus modifying both the coil current density and temperature distributions so as to reduce stresses and produce a more efficient coil.

Additional objects, advantages and novel features of the invention will be set forth in part in the description which follows, and in part will become apparent to those skilled in the art upon examintion of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings illustrate the present invention and together with the description and the rest of the specification, will serve to explain the principles of the invention. In the drawings.

DETAILED DESCRIPTION OF THE DRAWINGS

Figure 1:
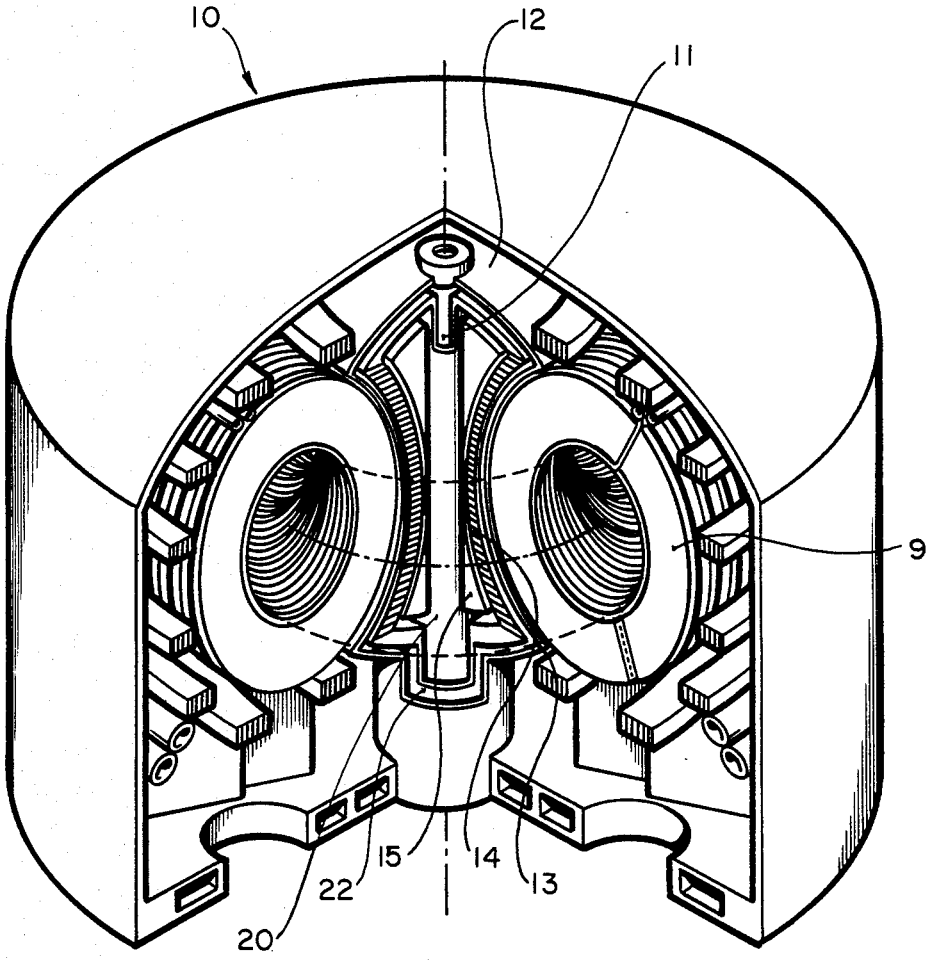
FIG. 1 is a perspective view of a compact toroidal reactor.

Reference will now be made in detail to the present, preferred embodiment of the invention, an example of which is illustrated in the accompanying drawings. FIG. 1 is a perspective, partial, cutaway view of a compact TFR in accordance with the present invention. Numeral 10 generally denotes the TFR. Centered about the hub 11 of the TFR and coaxial with it is an ohmic heating assembly 12. Disposed within the outer can 13 and the inner coaxial member 15 are a plurality of stacked flat washer-like members that constitute the ohmic heating coil 14.

Figure 2:
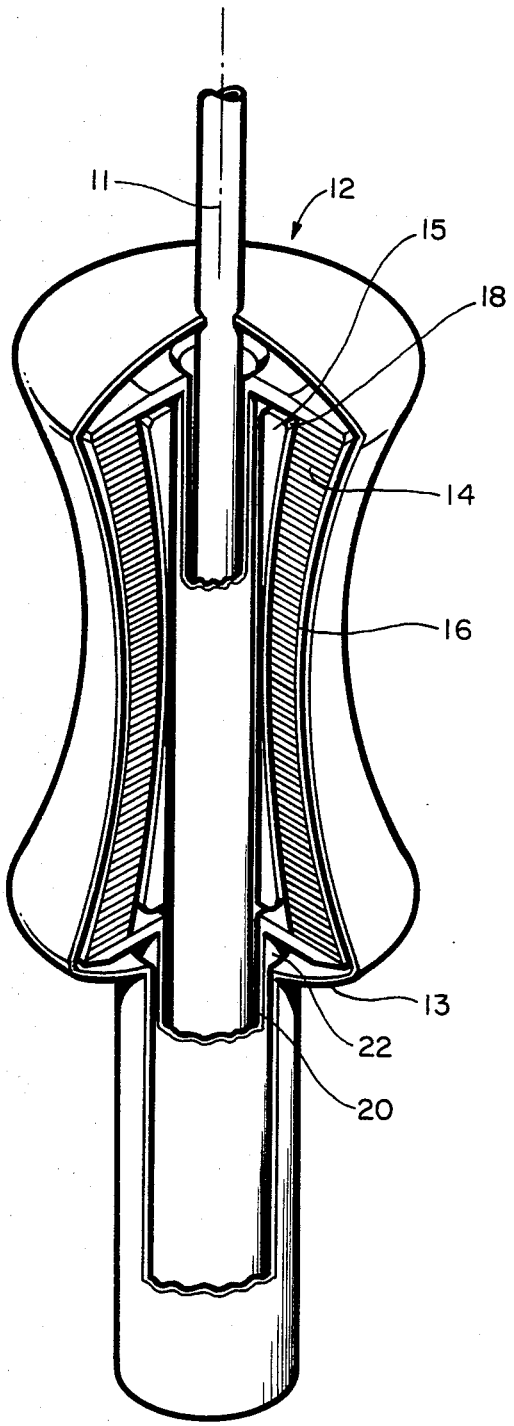
FIG. 2 is a perspective, partial, cutaway view of the ohmic heating coil of FIG. 1.

As can be more clearly seen in FIG. 2, the stacked washer-like members that constitute coil 14 are fed coolant through a coolant inlet 20 and are drained through a coolant outlet 22. Numeral 18 in FIG. 2 is used to identify the gap or space provided for coolant inlet to the individual OH coil turns, and numeral 16 indicates the small gap provided as the outlet channel from which the coolant leaves the individual coil turns. As will be understood by one of skill in the art, the flow of coolant between the inlet and outlet could be reversed making the coolant inlet 22 and the coolant outlet 20.

Figure 3:
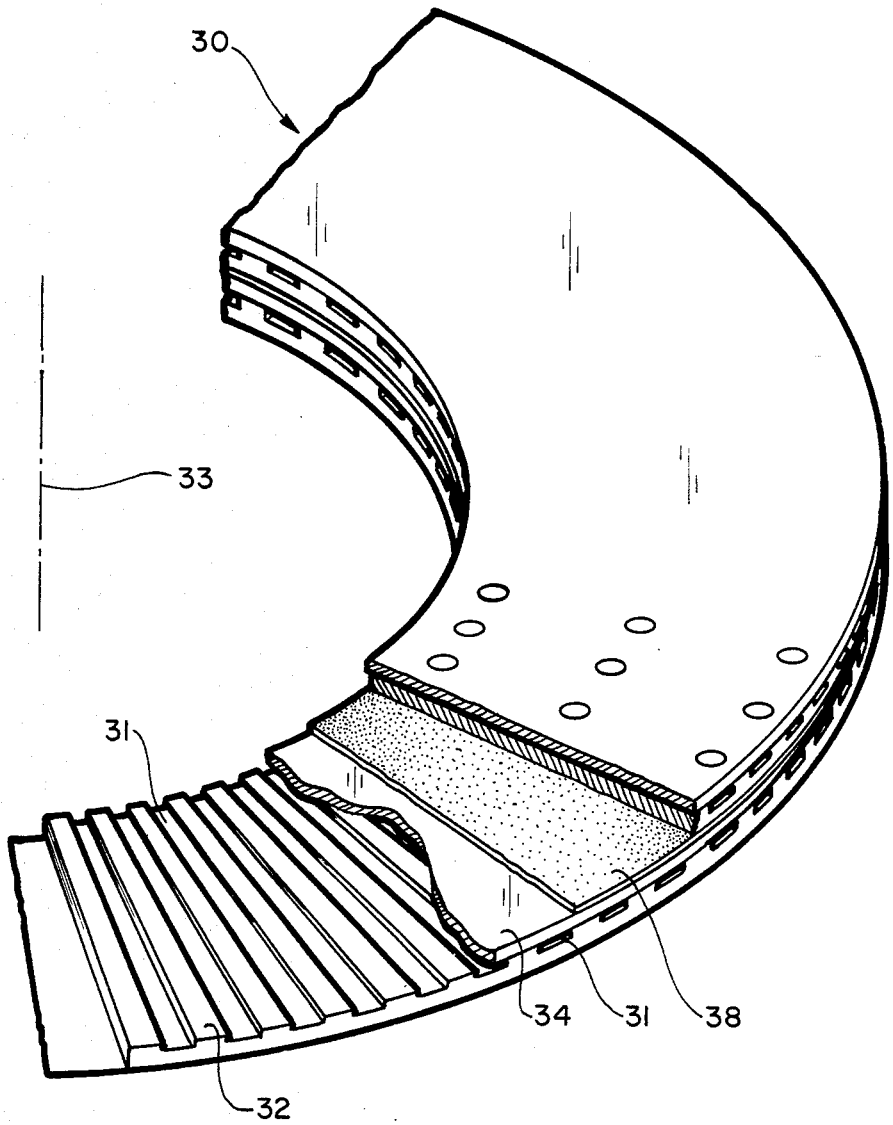
FIG. 3 is a perspective, partial, cutaway view of a section of a magnetic coil.

As can be appreciated by referring once again to FIG. 1, the OH coil assembly 12 is in very close proximity to the TF coil assembly generally indicated by numeral 9 in FIG. 1 and only very small gaps and clearances are available to accommodate coolant flow inlet and outlet to the ohmic heating coils. FIG. 3 depicts a coil turn wherein channels 31 are arranged radially on projections from the center 33 of the coil turn 30. A typical coil turn consists of a bottom plate 32 with channels 31 etched or machined into it covered by a flat washer-like section 34 and insulated from the next coil turn by insulating material 38.

Figure 4:
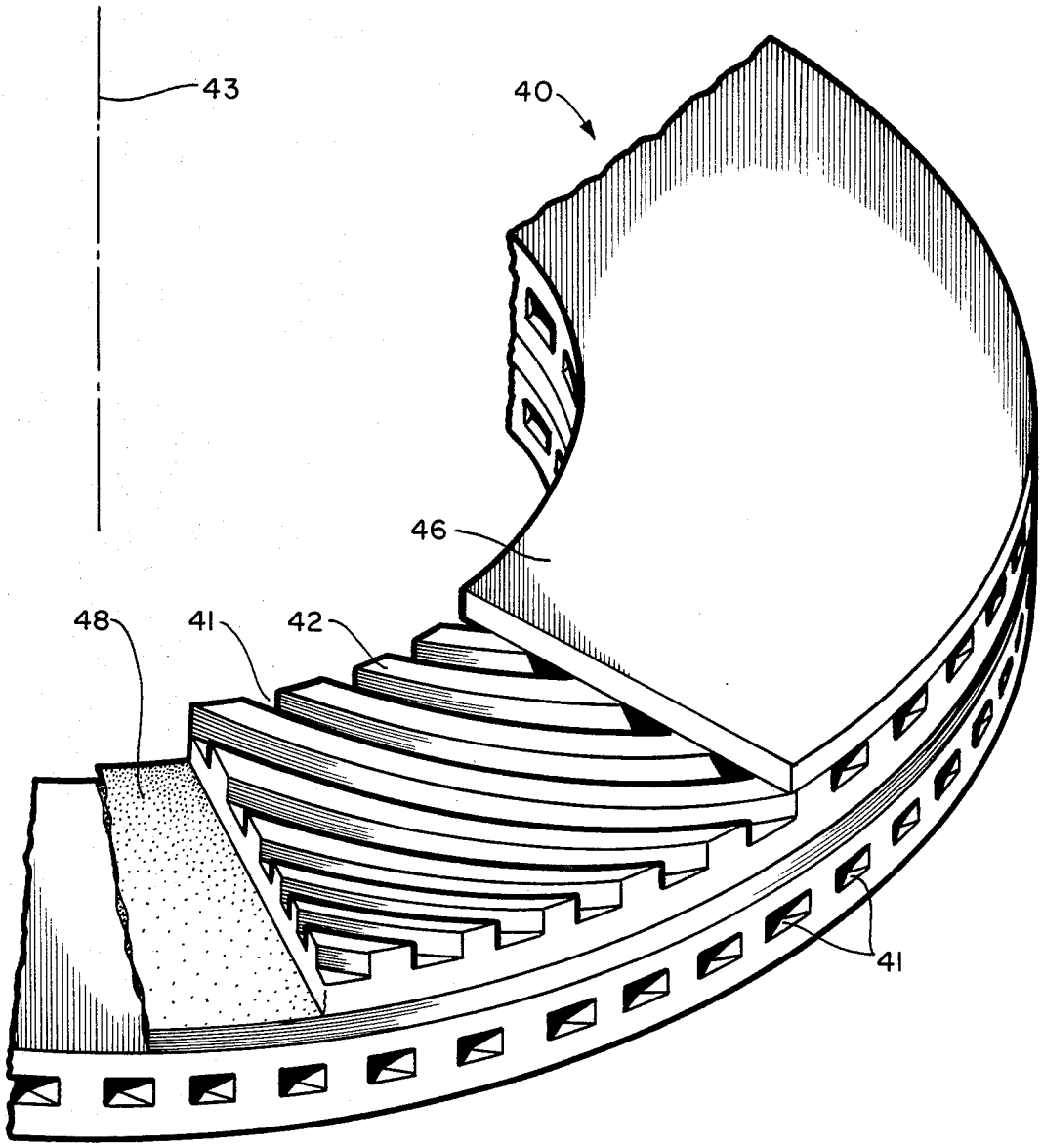
FIG. 4 is a perspective, partial, cutaway view of a magnetic coil in accordance with the present invention.

Turning now to FIG. 4, and in accordance with the present invention, there is described a coil turn 40 centered about a centerline 43 wherein channels 41 are constructed which are of constant width and spiral radially outward between the inner and outer edges. The channels 41 are etched, machined or cut into washer-like member 42 and then sandwiched by a washer-like member 46. It should be understood that washer-like member 46 can be similarly etched, machined or cut with complementary channels so that the channels 41 will be partially deposed in bottom member 42 and top member 46. Alternatively, the channels can be cut, machined or etched in the top or bottom of a single washer-like member which is then insulated with an insulating means 48 from the next adjacent turn. In that case, it should be understood that the cooling channel will be along the surface but still partially within the magnetic coil. The channels extend over a portion less than the circumference of the coil turn.

Figure 5:
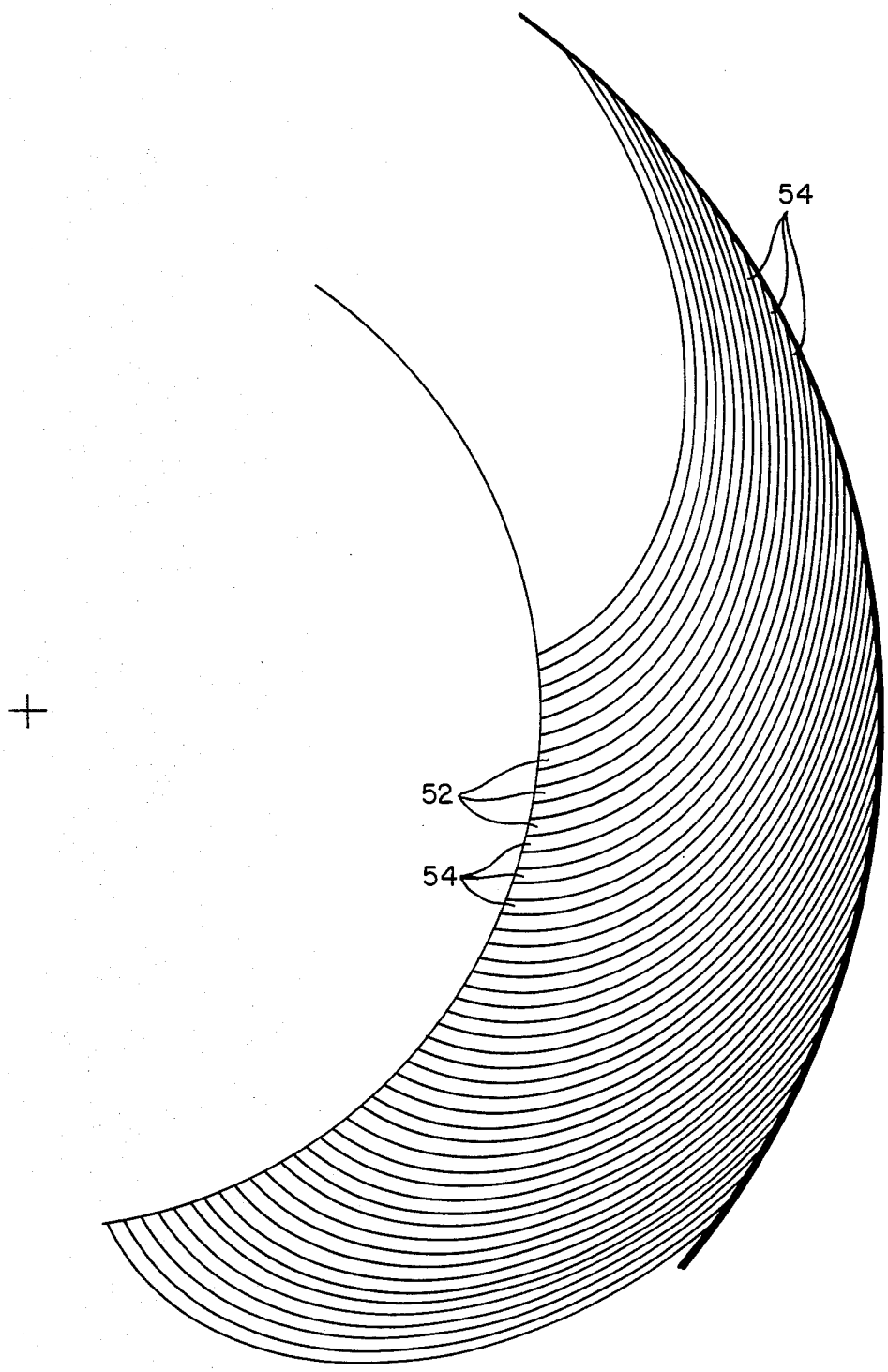
FIG. 5 is a plane view of another embodiment of a magnetic coil in accordance with the present invention.

Turning to FIG. 5, there is illustrated an alternate embodiment of the invention wherein the coolant channels 52 are of constantly varying width and are separated by land areas (lands) 54. It should be noted that the angle of the spiral is constantly changing to control the length of the cooling channel within the coil turn. It is by controlling the width and/or the height of the cooling channel as well as the length of the cooling channel that one can tailor pressure drop and heat transfer and thus control the flow of coolant through the cooling channels of individual turns so as to optimally remove heat from the entire magnetic coil means in accordance with the desired temperature gradients.

Figure 6:
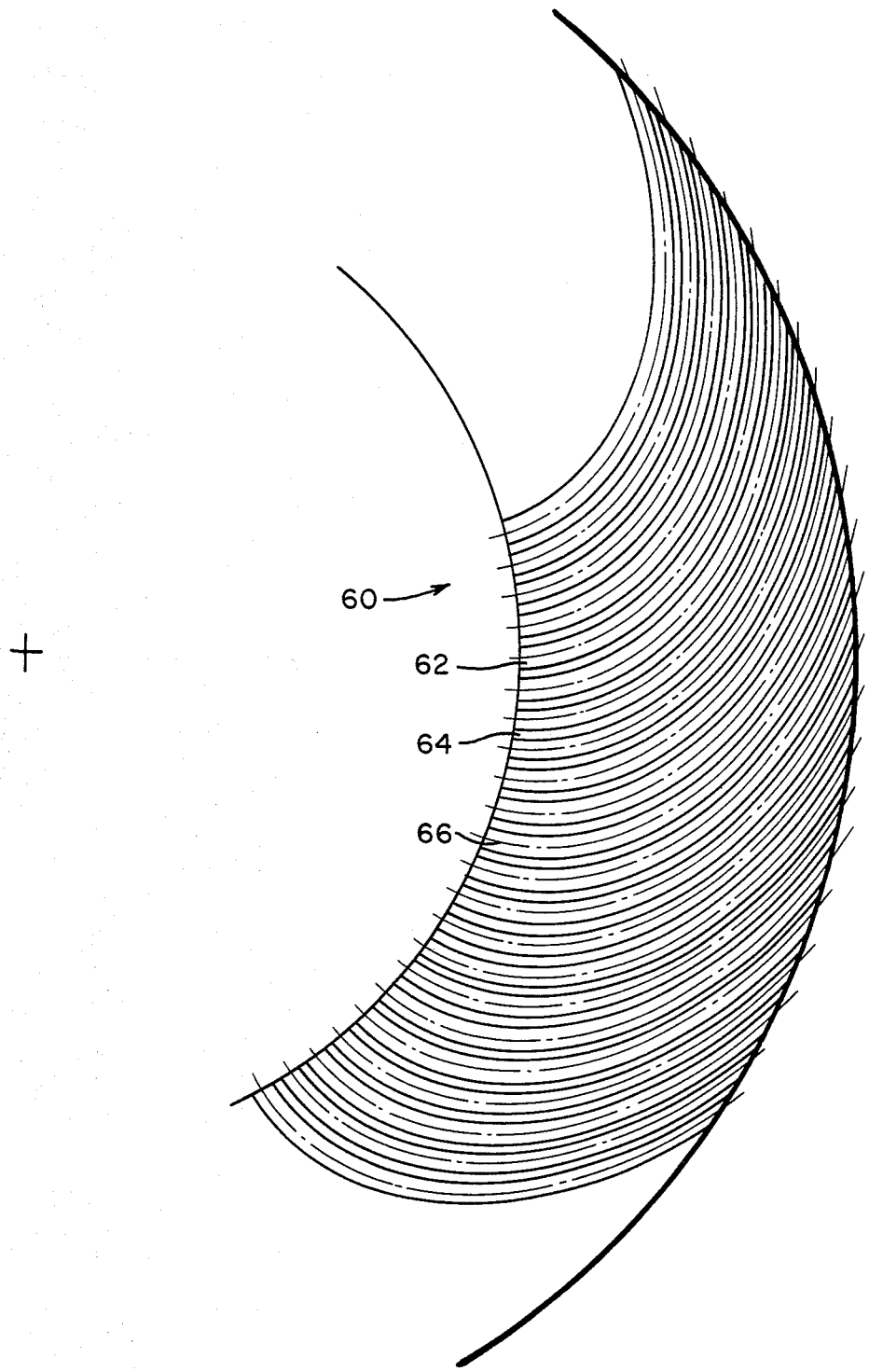
FIG. 6 is a plane, partial view of another embodiment of a magnetic coil in accordance with the present invention.

Turning now to FIG. 6, there is disclosed an alternate embodiment of magnetic coil 60 having coolant channels, typically designated 62, each coolant channel having a center line 66 and being separated from the adjacent cooling channel by a land 64. It should be noted that the land 64 with respect to the channel 62 can be controlled so as to be narrower or wider in accordance with the cooling desired. It will also be apparent to the artisan that the cross-sectional area of the coolant channels can be varied in FIG. 6 in a manner similar to that depicted in FIG. 5. Alternatively, the width of the lands 64 can be varied in a manner similar to that depicted in FIG. 5 for the cooling channels. It will also be apparent to one of skill in this art that the angle of the radial spiral can be constantly varied so as to make the effective length of the cooling channel as long as desired thereby controlling the pressure drop of the coolant within that channel.

Figure 7:
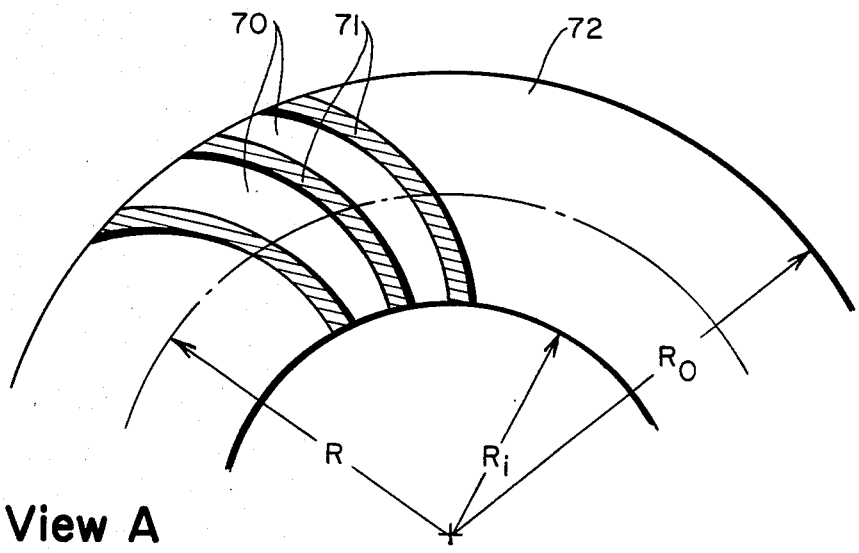
FIG. 7 is a diagram depicting the coolant channel geometry.
Figure 7:
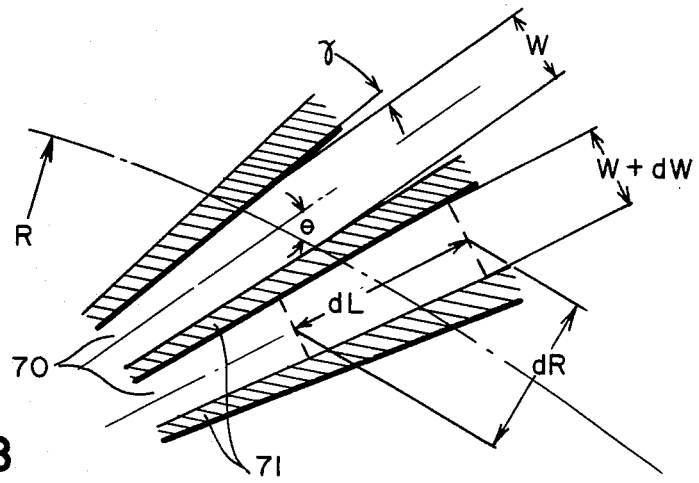

The coolant channels of the present invention are based on the concept that the channels trace a spiral or involute path between the inner and outer radii of the coil turn and get wider, narrower, or remain of constant width as a function of radial location. By selecting the proper parameters, e.g., number of channels, ratio of channel width to channel spacing, channel wall divergence or convergence angle, and inner radius intersect angle, the thermal/hydraulic performance of the channels can be tailored to achieve the desired control over channel pressure drop, heat transfer, and coil stresses. FIG. 7 illustrates spiral cooling channels 70 separated by lands of material 71. View A indicates a coil turn 72 having an inner radius $R_i$ and an outer radius $R_o$. View B is an enlargement of the channels 70 and lands 71 at a radius R, and indicates some of the geometric quantities used in developing the channel parametric equations. Those equations, developed in connection with the geometry of FIG. 7, are as follows:

Let

W=channel width at radius R $W_i$=channel width at radius $R_1$ $C_1$=channel width/channel spacing $N_c$=number of coolant channels per coil turn $R_i$=radius to inner edge of coil turn $R_o$=radius to outer edge of coil turn R=radius to some point in coil turn L=channel length measured from the inner radius $R_i$ to radius R $2\gamma$=channel wall divergence angle $\theta$=angle that channel centerline makes with respect to tangent of circle of radius R $\theta_i$=value of $\theta$ at inner radius.

Where (from FIG. 7):

$$dW = 2dL \tan \gamma, \tag{1}$$

$$\sin \theta = \frac{dR}{dL}.$$

Therefore $$W = W_i 2L \tan \gamma, \tag{3}$$

but $$W_i = 2R_i \sin\left(\frac{\pi C_1}{N_c}\right) \sin \theta_i. \tag{4}$$

Therefore, $$W = 2R_i \sin\left(\frac{\pi C_1}{N_c}\right) \sin \theta_i + 2L \tan \gamma. \tag{5}$$

The solutions for channel width W and channel length L are dependent upon the value assumed for $\theta_i$. The possible range for $\theta_i$ is:

$$0 < \theta_i \leqq \pi/2. \tag{6}$$

Families of spiral channels can be designed having varying values for $\theta_i$. FIG. 4 illustrates spiral channels having $\theta_i$ less than $\pi/2$. FIGS. 5 and 6 illustrate spiral channels having $\theta_i$ equal to $\pi/2$. It can be shown, therefore, that $$L = \frac{-R_i \sin \theta_i \sin\left(\frac{\pi C_1}{N_c}\right) + \sqrt{\left[R_i \sin \theta_i \sin\left(\frac{\pi C_1}{N_c}\right)\right]^2 + (R^2 - R_i^2) \sin\left(\frac{\pi C_1}{N_c}\right) \tan \gamma}}{\tan \gamma}. \tag{7}$$

For constant width channels (i.e., $\gamma=0$) the solution for channel length is $$L = \frac{R^2 - R_i^2}{2R_i \sin \theta_i}. \tag{8}$$

The channel flow width, W perpendicular to the flow axis is $$W = 2\sqrt{\left[R_i \sin \theta_i \sin\left(\frac{\pi C_1}{N_c}\right)\right]^2 + (R^2 - R_i^2) \sin\left(\frac{\pi C_1}{N_c}\right) \tan \gamma}. \tag{9}$$

The upper limit for $\gamma$ is when the channel has no curvature, i.e., $$\tan \gamma = \sin\left(\frac{\pi C_1}{N_c}\right) \sin^2 \theta_i. \tag{10}$$

The lower limit for $\gamma$ is when the channel converges to where it has zero width at the outer radius, i.e., $$\tan \gamma < -\sin\left(\frac{\pi C_1}{N_c}\right) \left[\frac{R_i^2 \sin^2 \theta_i}{R_o^2 - R_i^2}\right]. \tag{11}$$

Therefore, the limits on $\gamma$ are $$\tan^{-1}\left[-\sin\left(\frac{\pi C_1}{N_c}\right)\left(\frac{R_i^2\sin^2\theta_i}{R_o^2-R_i^2}\right)\right] < \gamma \leqq \tan^{-1}\left[\sin\left(\frac{\pi C_1}{N_c}\right)\sin^2\theta_i\right]. \quad (12)$$

It is necessary to define the equation that plots that path of the channel centerline. This equation is $$\phi = f(R,\gamma,R_i,\theta_i,C_1,N_c), \quad (13)$$

where for reference purposes $\phi$ is assumed to be zero where the channel centerline intersects the coil turn inner radius.

It can be shown that:

$$\phi = \int_{R_i}^{R}\left\{\frac{R^2\left[1-\frac{\tan\gamma}{\sin(\pi C_1/N_c)}\right]-R_i^2\left[\sin^2\theta_i-\frac{\tan\gamma}{\sin(\pi C_1/N_c)}\right]}{R^2\frac{\tan\gamma}{\sin(\pi C_1/N_c)}+R_i^2\left[\sin^2\theta_i-\frac{\tan\gamma}{\sin(\pi C_1/N_c)}\right]}\right\}^{\frac{1}{2}}\frac{dR}{R}. \quad (14)$$

Let $$E = \frac{\tan\gamma}{\sin(\pi C_1/N_c)-\tan\gamma}, \quad (15)$$

and $$L = \frac{\sin(\pi C_1/N_c)\sin^2\theta_i-\tan\gamma}{\sin(\pi C_1/N_c)-\tan\gamma}, \quad (16)$$

therefore, $$\phi = \int_{R_i}^{R}\left(\frac{R^2-LR_i^2}{ER^2+LR_i^2}\right)^{\frac{1}{2}}\frac{dR}{R}. \quad (17)$$

There are three solutions for this integral, depending on the domain for E.

For E=0(constant width channels)

$$\phi = \left(\frac{R^2-R_i^2\sin^2\theta_i}{R_i^2\sin^2\theta_i}\right)^{\frac{1}{2}} - \operatorname{cotan}\theta_i - \tan^{-1}\left(\frac{R^2-R_i^2\sin^2\theta_i}{R_i^2\sin^2\theta_i}\right)^{\frac{1}{2}} + \frac{\pi}{2} - \theta_i. \quad (18)$$

For E<0(converging channels)

$$\phi = \frac{-1}{\sqrt{-E}}\tan^{-1}\left[\frac{E\sqrt{(R^2-LR_i^2)/(ER^2+LR_i^2)}}{\sqrt{-E}}\right] - \tan^{-1}\sqrt{\frac{R^2-LR_i^2}{ER^2+LR_i^2}} + \frac{1}{\sqrt{-E}}\tan^{-1}\left[\frac{E\sqrt{(1-L)/(E+L)}}{\sqrt{-E}}\right] + \tan^{-1}\sqrt{\frac{1-L}{E+L}}. \quad (19)$$

For E>0(diverging channels)

$$\phi = \frac{1}{\sqrt{E}}\tanh^{-1}\left(\sqrt{E}\sqrt{\frac{R^2-LR_i^2}{ER^2+LR_i^2}}\right) - \tan^{-1}\left(\sqrt{\frac{R^2-LR_i^2}{ER^2+LR_i^2}}\right) - \frac{1}{\sqrt{E}}\tanh^{-1}\left(\sqrt{E}\sqrt{\frac{1-L}{E+L}}\right) + \tan^{-1}\left(\sqrt{\frac{1-L}{E+L}}\right). \quad (20)$$

The derivations above are based on the assumption that the coolant channel wall has a divergence angle of $2\gamma$ and the ratio of channel width to channel spacing is equal to $C_1$, and is independent of radius. A slightly different, but related family of cooling channels can be generated based upon the assumptions that the divergence angle between adjacent coolant channel centerlines is $2\gamma$ and the divergence angle of the cooling channel walls is $2_w$. Therefore, the channel length becomes $$L = \frac{-R_i\sin\frac{\pi}{N_c}\sin\theta_i+\sqrt{\left(R_i\sin\frac{\pi}{N_c}\sin\theta_i\right)^2+(R^2-R_i^2)\sin\frac{\pi}{N_c}\tan\gamma}}{\tan\gamma}. \quad (21)$$

The channel width becomes $$W = W_i + 2\left[-R_i \sin\frac{\pi}{N_c}\sin\theta_i + \sqrt{\left(R_i \sin\frac{\pi}{N_c}\sin\theta_i\right)^2 + (R^2 - R_i^2)\sin\frac{\pi}{N_c}\tan\gamma}\right]\frac{\tan\gamma_w}{\tan\gamma}. \quad (22)$$

and the channel centerline position angle $\phi$ is defined by the same equations as before except the parameters E and L are defined as $$E = \frac{\tan\gamma}{\sin(\pi/N_c) - \tan\gamma}, \quad (23)$$

and $$L = \frac{\sin(\pi/N_c)\sin^2\theta_i - \tan\gamma}{\sin(\pi/N_c) - \tan\gamma}. \quad (24)$$

For these channels the limits on $\gamma$ are:

$$\tan^{-1}\left(-\sin\frac{\pi}{N_c}\left(\frac{R_i^2\sin^2\theta_i}{R_o^2 - R_i^2}\right)\right] < \gamma \leqq \tan^{-1}\left(\sin\frac{\pi}{N_c}\sin^2\theta_i\right). \quad (25)$$

Coolant channels, designed in accordance with the aforesaid analysis, can be tailored geometrically to yield a radial variation in cooling characteristics such that current density and temperature distributions can be affected so as to reduce stresses and have a more efficient coil. Peak stresses can be reduced by having material temperature decrease with increasing radius. Moreover, the cooling channels can be tailored such that sufficient coolant pressure drop is developed within the channels to provide for a good coolant flow distribution to the individual coil turns.

It will be appreciated by one of skill in the art that coolant channels, designed according to the present invention, follow a spiralling or involute path, distributing the land area 71 (FIG. 7) in such a manner as to improve the structural characteristics of the coil and that coolant channels 70 so designed cross the radial lines of the coil, and form highly skewed angles with respect to those radial lines, thereby premitting fewer channels to be used to effectively blanket the entire coil turn. In addition, the cooling channels so designed intersect the coil's outer coolant manifold at a skewed angle, resulting in lower coolant pressure loss at the junction of the manifold and coolant channel.

The foregoing description of a preferred embodiment of the invention has been prepared for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular used contemplated. It is intended that the scope of the invention be defined by the claims appended hereto.

What is claimed is:

1. A toroidal fusion reactor assembly comprising:

(a) a plurality of toroidal field (TF) coils;

(b) a plurality of ohmic heating (OH) coils disposed inside the toroid of said TF coils, said OH coils cooled by a cooling fluid;

(c) each of said OH coils comprising two flat washer-like members placed together and having a common inner radius $R_i$ and an outer radius $R_o$;

(d) an inlet for said cooling fluid to pass to said OH coils;

(e) an outlet for receiving cooling fluid from said OH coils; and (f) each of said OH coils including at least one magnetic coil turn, said coil turn being one of said two flat washer-like members and said coil turn having a plurality of radially outwardly spiralling cooling channels for controlling the passage of cooling fluid through said coil turn, each channel extending from said inner radius $R_i$ to said outer radius $R_o$ in a continually increasing radial amount and extending over a portion less than the circumference of said coil turn, whereby the coil turn cooling characteristics are radially varied.

2. The assembly as recited in claim 1, wherein said two flat washer-like members comprise a conductor and an insulator.

3. The assembly of claim 1, wherein said plurality of magnetic coil turns is enclosed in a can means, said can means closely following inner and outer contours of said plurality of magnetic coil turns.

4. The assembly of claim 3, wherein said can consists of an outer member disposed about a central axis and a coaxial inner member, said plurality of magnetic coil turns being deposed between the inner member and the outer member of said can.

5. The assembly of claim 4, wherein said coolant inlet includes the gap between the inner member of said can and the inner edge of said magnetic coil turns and said coolant outlet includes the gap between the outer member and the outer edge of said magnetic coil turns.

6. The assembly of claim 4, wherein said coolant outlet includes the gap between the inner member of said can and the inner edge of said magnetic coil turns and said coolant outlet includes the gap between the outer member and the outer edge of said magnetic coil turns.

7. The assembly of claim 4, 5 or 6, wherein said inner and outer members have a generally hourglass configuration.

8. The assembly of claims 5 or 6, wherein the length and cross-sectional area of the coolant channels are dimensioned to create a pressure drop sufficiently greater than the pressure drop in the coolant outlet gap whereby control can be maintained of coolant flow distribution.

9. The assembly of claim 8, wherein the coolant channels have a constant width over their length.

10. The assembly of claim 8, wherein the coolant channels have a varying width over their length.

11. The assembly of claims 5 or 6, wherein the spiral coolant channels are formed to create a sufficient pressure drop to control the coolant flow distribution.

12. The assembly of claim 10, wherein said coolant channel width diverges with increasing radius from said central axis.

13. The assembly of claim 10, wherein said cooling channel width converges with increasing radius from said central aixs.

14. The assembly of claim 1, wherein said coolant channel means comprises a plurality of coolant channels having a channel length L defined by the equation $$L = \frac{-R_i \sin \frac{\pi}{N_c} \sin \theta_i + \sqrt{\left(R_i \sin \frac{\pi}{N_c} \sin \theta_i\right)^2 + (R^2 - R_i^2) \sin \frac{\pi}{N_c} \tan \gamma}}{\tan \gamma}$$

where $C_1$=coolant channel width divided by coolant channel spacing $N_c$=number of coolant channels per coil turn $R_i$=radius to inner edge of coil turn R=radius to any point of coil turn $2\gamma$=coolant channel wall divergence angle L=channel length measured from the inner radius $R_i$ to radius R.

15. The assembly of claim 14, wherein the coolant channels have a width W at a radius R defined by the equation $$W = 2\sqrt{\left[R_i \sin \theta_i \sin\left(\frac{\pi C_1}{N_c}\right)\right]^2 + (R^2 - R_i^2) \sin\left(\frac{\pi C_1}{N_c}\right) \tan \gamma}$$

16. The assembly of claim 14, wherein the coolant channels have a centerline position angle $\phi$ defined by the equation $$\phi = \int_{R_i}^{R} \left(\frac{R^2 - LR_i^2}{ER^2 + LR_i^2}\right)^{\frac{1}{2}} \frac{dR}{R},$$

where $$E = \frac{\tan \gamma}{\sin (\pi C_1/N_c) - \tan \gamma},$$

$$L = \frac{\sin (\pi C_1/N_c) \sin^2 \theta_i - \tan \gamma}{\sin (\pi C_1/N_c) - \tan \gamma},$$

and

E=0 for constant width channels

E<0 for converging channels

E>0 for diverging channels.

17. The assembly of claim 1, wherein said comprises a plurality of have a channel length L defined by the equation $$L = \frac{-R_i \sin \frac{\pi}{N_c} \sin \theta_i + \sqrt{\left(R_i \sin \frac{\pi}{N_c} \sin \theta_i\right)^2 + (R^2 - R_i^2) \sin \frac{\pi}{N_c} \tan \gamma}}{\tan \gamma}$$

where $R_i$=radius to inner edge of coil turn $N_c$=number of coolant channels per coil turn R=radius to any point of coil turn $2\gamma$=divergence angle between adjacent coolant channel centerlines L=channel length measured from the inner radius $R_i$ to radius R.

18. The assembly of claim 17, wherein said coolant channel width W is defined by the equation $$W = W_i + 2\left[-R_i \sin \frac{\pi}{N_c} \sin \theta_i + \sqrt{\left(R_i \sin \frac{\pi}{N_c} \sin \theta_i\right)^2 + (R^2 - R_i^2) \sin \frac{\pi}{N_c} \tan \gamma}\right] \frac{\tan \gamma_w}{\tan \gamma},$$

where $2\gamma_w$=divergence angle of coolant channel walls and where $W_i$=the channel width at the inner radius $R_i$.

19. The assembly of claim 18, wherein said coolant channel centerline position angle $\phi$ is defined by the equation:

$$\phi = \int_{R_i}^{R} \left(\frac{R^2 - LR_i^2}{ER^2 + LR_i^2}\right)^{\frac{1}{2}} \frac{dR}{R},$$

where $$E = \frac{\tan \gamma}{\sin (\pi/N_c) - \tan \gamma}$$

and $$L = \frac{\sin (\pi/N_c) \sin^2 \theta_i - \tan \gamma}{\sin (\pi/N_c) - \tan \gamma},$$

and

E=0 for constant width channels

E<0 for converging channels

E>0 for diverging channels.

20. A method of controlling the flow distribution of coolant fluid through coolant channels in ohmic heating magnetic coils of a tokamak-type toroidal fusion reactor comprising the steps of:

providing a coolant inlet means to said magnetic coils having a static pressure rise;

providing a coolant outlet means from said magnetic coils having a static pressure drop;

stacking a plurality of flat washer-like disk magnetic coil turns into an assembly and distributing cooling fluid to all of said plurality of coil turns throughout said assembly to cool the turns in accordance with the local temperature gradients desired in the magnetic coil turns;

providing radially spiralling cooling channels in said magnetic coils having a sufficient pressure drop relative to said static pressure rise and static pressure drop to ensure adequate coolant flow distribution through said channels, said radially spiralling coolant channels provided in said plurality of coil turns and each extending over a portion less than the circumference of said coil turn;

passing coolant from said inlet means, through said coolant channels and to said outlet means.

21. The method of claim 20, whereby the step of providing spiral shaped coolant channels includes furnishing channels of constant width.

22. The method of claim 20, whereby the step of providing spiral shaped coolant channels includes furnishing channels of varying width.

23. The method of claim 20, whereby the step of providing spiral shaped coolant channels includes controlling the coolant channel pressure drop by varying the coolant channel length.

24. The method of claim 20, wherein the step of providing coolant channels comprises providing a plurality of coolant channels having a channel length L defined by the equation:

$$L = \frac{-R_i \sin\left(\frac{\pi C_1}{N_c}\right) + \sqrt{\left[R_i \sin\theta_i \sin\left(\frac{\pi C_1}{N_c}\right)\right]^2 + (R^2 - R_i^2)\sin\left(\frac{\pi C_1}{N_c}\right)\tan\gamma}}{\tan\gamma}$$

where $C_1$=coolant channel width divided by coolant channel spacing $N_c$=number of coolant channels per coil turn $R_i$=radius to inner edge of coil turn R=radius to any point of coil turn $2\gamma$=coolant channel wall divergence angle L=channel length measured from the inner radius $R_i$ to radius R.

25. The method of claim 24 further comprising the step of providing coolant channels having a width W at a radius R defined by the equation:

$W =$

-continued $$2\sqrt{\left[R_i \sin\theta_i \sin\left(\frac{\pi C_1}{N_c}\right)\right]^2 + (R^2 - R_i^2)\sin\left(\frac{\pi C_1}{N_c}\right)\tan\gamma}\ .$$

26. The method of claim 25 further comprising the step of providing coolant channels with centerlines defined by the equation:

$$\phi = \int_{R_i}^{R}\left(\frac{R^2 - LR_i^2}{ER^2 + LR_i^2}\right)^{\frac{1}{2}}\frac{dR}{R},$$

where $$E = \frac{\tan\gamma}{\sin(\pi C_1/N_c) - \tan\gamma},$$

$$L = \frac{\sin(\pi C_1/N_c)\sin^2\theta_i - \tan\gamma}{\sin(\pi C_1/N_c) - \tan\gamma},$$

and

E=0 for constant width channels

E<0 for converging channels

E>0 for diverging channels.

27. The method of claim 20, wherein the step of providing coolant channels comprises providing a plurality of coolant channels having a channel length L defined by the equation.

$$L = \frac{-R_i \sin\frac{\pi}{N_c}\sin\theta_i + \sqrt{\left(R_i \sin\frac{\pi}{N_c}\sin\theta_i\right)^2 + (R^2 - R_i^2)\sin\frac{\pi}{N_c}\tan\gamma}}{\tan\gamma},$$

where $R_i$=radius to inner edge of coil turn $N_c$=number of coolant channels per coil turn R=radius to any point of coil turn $2\gamma$=divergence angle between adjacent coolant channel centerlines L=channel length measured from the inner radius $R_i$ to radius R.

28. The method of claim 27 further comprising the step of providing coolant channels having a width W defined by the equation:

$$W = W_i + 2\left[-R_i \sin\frac{\pi}{N_c}\sin\theta_i + \sqrt{\left(R_i \sin\frac{\pi}{N_c}\sin\theta_i\right)^2 + (R^2 - R_i^2)\sin\frac{\pi}{N_c}\tan\gamma}\right]\frac{\tan\gamma_w}{\tan\gamma},$$

where $2\gamma_w$=divergence angle of cooolant channel walls and where $W_i$ is the channel width at the inner radius $R_i$.

29. The method of claim 28 further comprising the step of providing coolant channels with centerline position angle defined by the equation:

$$\phi = \int_{R_i}^{R} \left( \frac{R^2 - LR_i^2}{ER^2 + LR_i^2} \right)^{\frac{1}{2}} \frac{dR}{R},$$

where $$E = \frac{\tan \gamma}{\sin (\pi/N_c) - \tan \gamma},$$

$$L = \frac{\sin (\pi/N_c) \sin^2 \theta_i - \tan \gamma}{\sin (\pi/N_c) - \tan \gamma},$$

and

E=0 for constant width channels

E<0 for converging channels

E>0 for diverging channels.

* * * * *